US007290754B2

(12) United States Patent
Mensi et al.

(10) Patent No.: US 7,290,754 B2
(45) Date of Patent: Nov. 6, 2007

(54) T-POST PULLER

(76) Inventors: David E. Mensi, 1075 Curtis Rd., Michigan City, MS (US) 38647; Johnny C. Mensi, 411 Ripley Ave., Ashland, MS (US) 38603

( * ) Notice: Subject to any disclaimer, the term of this patent is extended or adjusted under 35 U.S.C. 154(b) by 0 days.

(21) Appl. No.: 11/585,987

(22) Filed: Oct. 25, 2006

(65) Prior Publication Data

US 2007/0090332 A1 Apr. 26, 2007

Related U.S. Application Data

(60) Provisional application No. 60/730,042, filed on Oct. 26, 2005.

(51) Int. Cl.
*E21B 19/00* (2006.01)

(52) U.S. Cl. ..... 254/30; 254/134; 254/133 R

(58) Field of Classification Search ..... 254/30, 254/133 R, 132, 134
See application file for complete search history.

(56) References Cited

U.S. PATENT DOCUMENTS

| | | | | |
|---|---|---|---|---|
| 1,533,429 | A | 4/1925 | Koehn | |
| 2,807,494 | A | 9/1957 | Bulfer, Jr. | |
| 3,762,687 | A | 10/1973 | De Rome et al. | |
| 4,226,402 | A | 10/1980 | Muth | |
| 4,256,286 | A | 3/1981 | Hudgins | |
| 4,721,335 | A | 1/1988 | Krenek, Jr. | |
| D312,196 | S | 11/1990 | Norona | |
| 5,022,632 | A | 6/1991 | Beideck | |
| 5,242,152 | A | 9/1993 | Schatz | |
| D372,177 | S | 7/1996 | Hansen | |
| 5,794,918 | A | 8/1998 | Price | |
| 6,056,271 | A * | 5/2000 | Riojas | 254/30 |
| 6,669,172 | B1 | 12/2003 | Bearden | |
| 6,978,983 | B1 * | 12/2005 | Sclease et al. | 254/30 |
| 7,059,587 | B1 * | 6/2006 | Fimple | 254/30 |

FOREIGN PATENT DOCUMENTS

| | | |
|---|---|---|
| GB | 1073096 | 6/1997 |

* cited by examiner

*Primary Examiner*—Lee D. Wilson
(74) *Attorney, Agent, or Firm*—Richard C. Litman

(57) ABSTRACT

The T-post puller is a device adapted for attachment to the a post hole digger boom of a tractor. The puller has a hollow body with a skirt at its bottom, which aids in positioning the main body over the T-post. A spring-biased, pivotally mounted wedge or ratchet plate extends along the interior length of the main body for engagement with any of the post's studs. The puller is further provided with a post release mechanism in the form of a rope attached to a lever connected to the wedge plate. The body has at least one yoke extending outwardly from the top end of the body for pivotal attachment to the boom. An adapter is attachable to the yoke in order to attached the puller to other power lifting booms or machines.

14 Claims, 4 Drawing Sheets

T-POST PULLER

CROSS-REFERENCE TO RELATED APPLICATION

This application claims the benefit of U.S. Provisional Patent Application Ser. No. 60/730,042, filed Oct. 26, 2005.

BACKGROUND OF THE INVENTION

1. Field of the Invention

The present invention relates to fence post removal devices, and more particularly to a T-post puller attachable to a tractor, backhoe, front-end loader, or the like.

2. Description of the Related Art

One form of fencing that can be installed quickly uses T-posts. T-posts are so-called because of their T-shape in cross section. T-posts have a row of studs projecting from the flat side of the crossbar for attaching and aligning wire fencing. T-posts may be quickly installed, particularly with a tube-type installation tool that can be placed over the post, lifted by handles attached to the sides of the tube, and allowed to drop. Weights in the top end of the tube drive the post into the ground by gravity. Quick installation and low fencing costs makes such fencing popular on farms, at construction sites, for use in gardens, etc.

However, removal of the T-fence posts can be quite a chore, particularly when the posts have been standing for several years so that the ground supporting the posts is no longer loose, and when there is a long run of fencing with many posts, e.g., one hundred or more, driven deeply into the ground. Manually pulling posts is hard on the back, and even with the aid of a manual post puller, sometimes requires two people. A tractor can be used by wrapping a chain around the post, but the chain often slips off the post, and much effort is required to constantly get up and down from the tractor to wrap the chain around successive posts. Consequently, there is a need for a T-post puller to reduce the physical labor involved in removing T-posts from the ground and that reduces the amount of time involved in pulling the posts.

Thus, a T-post puller solving the aforementioned problems is desired.

SUMMARY OF THE INVENTION

The T-post puller is a device adapted for attachment to a tractor's post hole digger boom, or to a conventional 3-point boom of a tractor with the aid of an adapter. The device may also be used with backhoes, front-end loaders, Bobcats, or any powered lifting device or machine. The puller has a hollow body, preferably rectangular, with a skirt at its bottom, which aids in positioning the main body over the T-post.

A spring-biased, pivotally mounted wedge or ratchet plate extends along the interior length of the main body for engagement with any of the T-post studs. A weight is mounted on top of the wedge to ensure engagement of the wedge with the stud in the event the spring fails to function properly. The puller is further provided with a post release mechanism in the form of a rope attached to a lever connected to the wedge. An adapter is also provided to aid in attaching the body of the puller to a power lifting machine (a machine having a hydraulically powered boom, an electrically operated winch, etc.) other than a post-hole digger boom.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
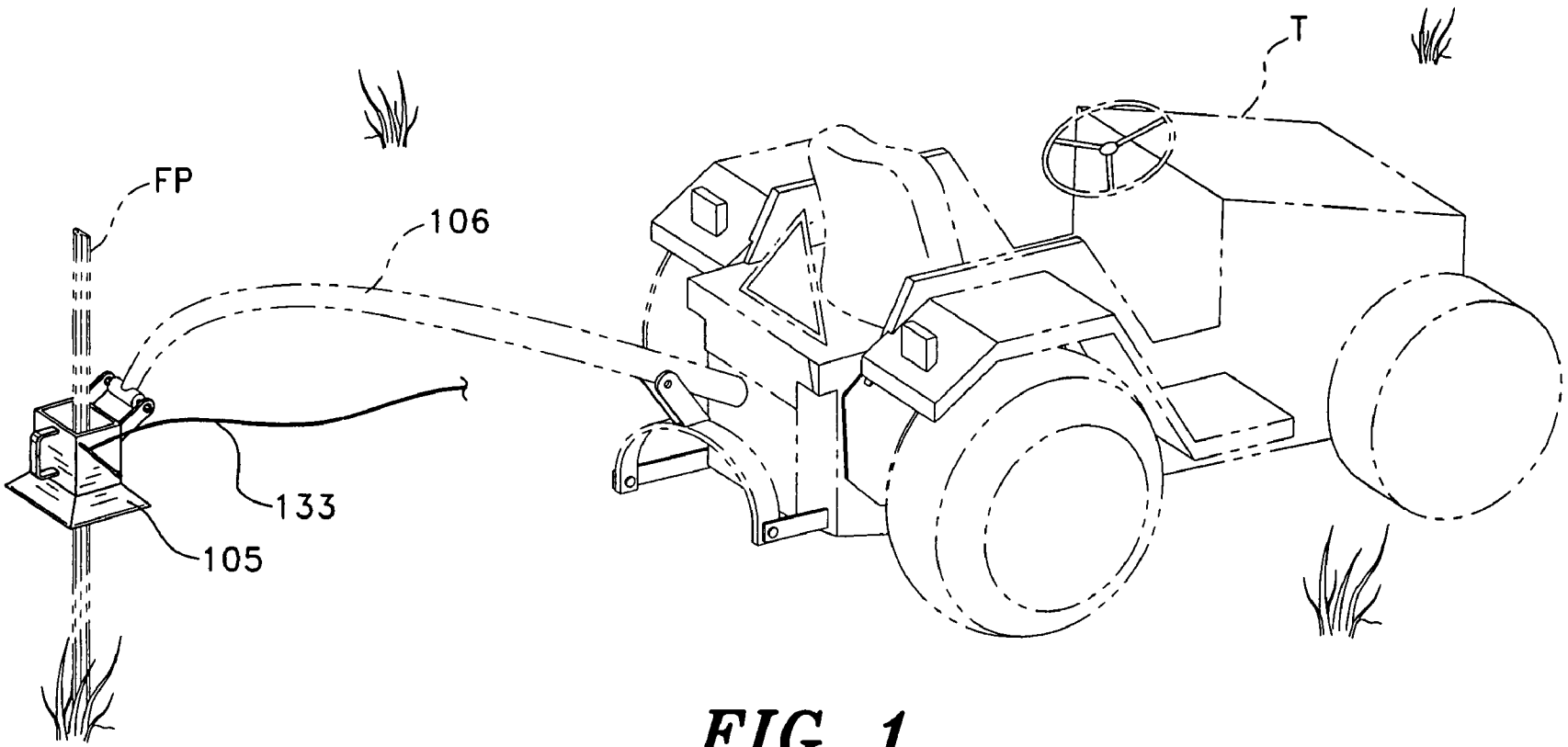
FIG. 1 is an environmental, perspective view of a T-post puller according to the present invention.
Figure 2A:
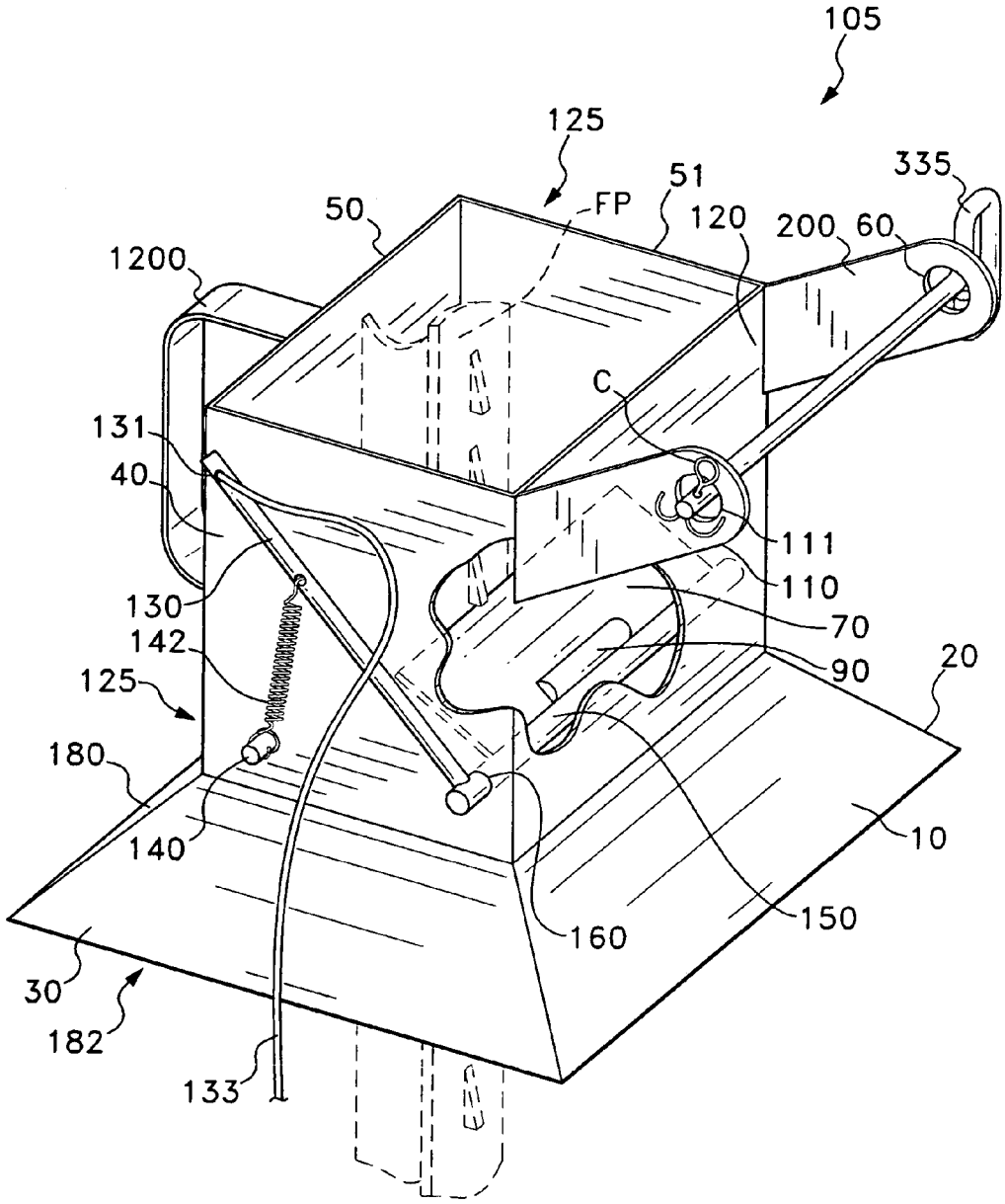
FIG. 2A is a perspective view of a T-post puller according to the present invention, a portion of the frame being broken away and in section to show internal components.
Figure 2B:
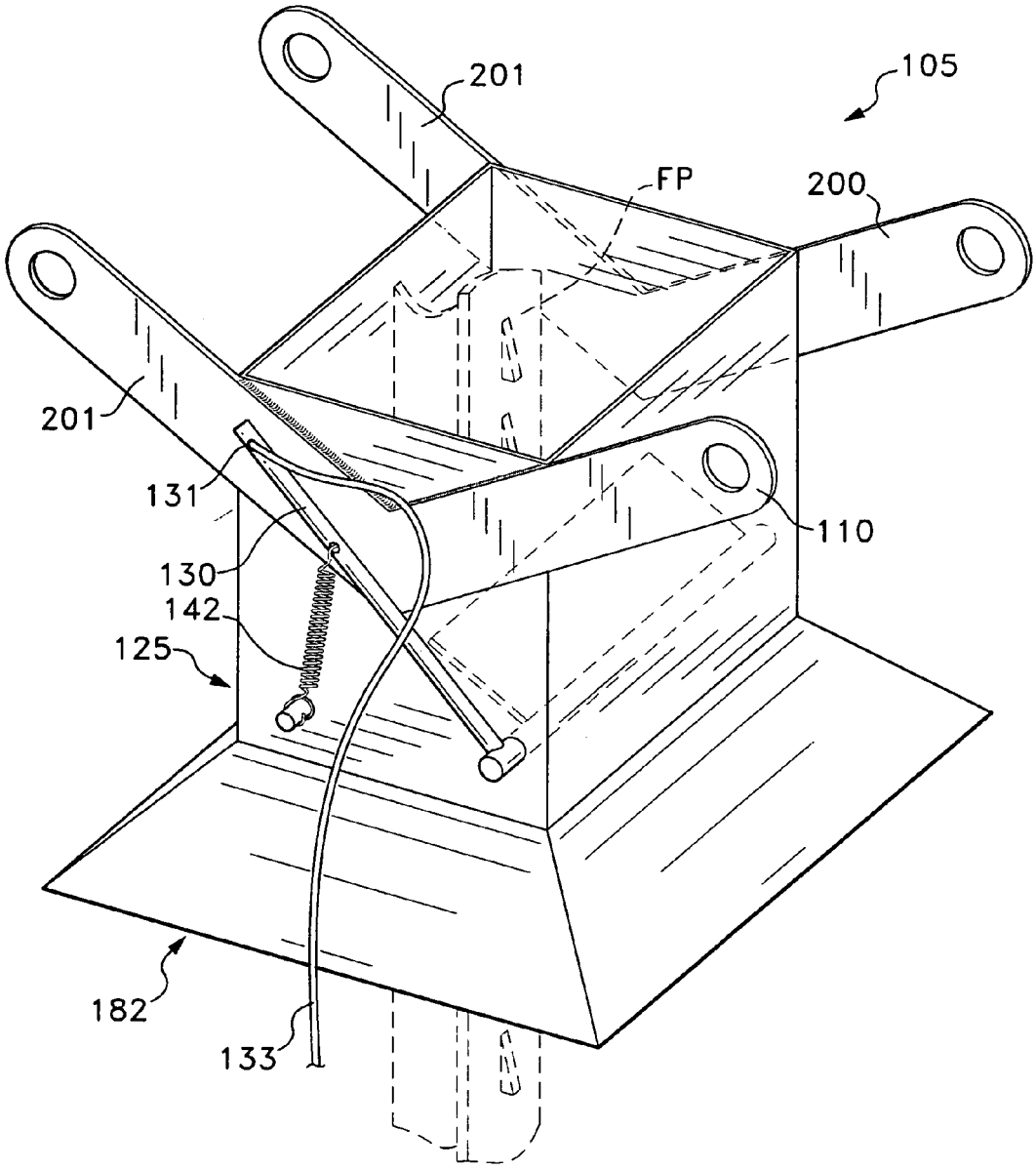
FIG. 2B is a perspective view of alternative embodiment of a T-post puller according to the present invention.
Figure 3:
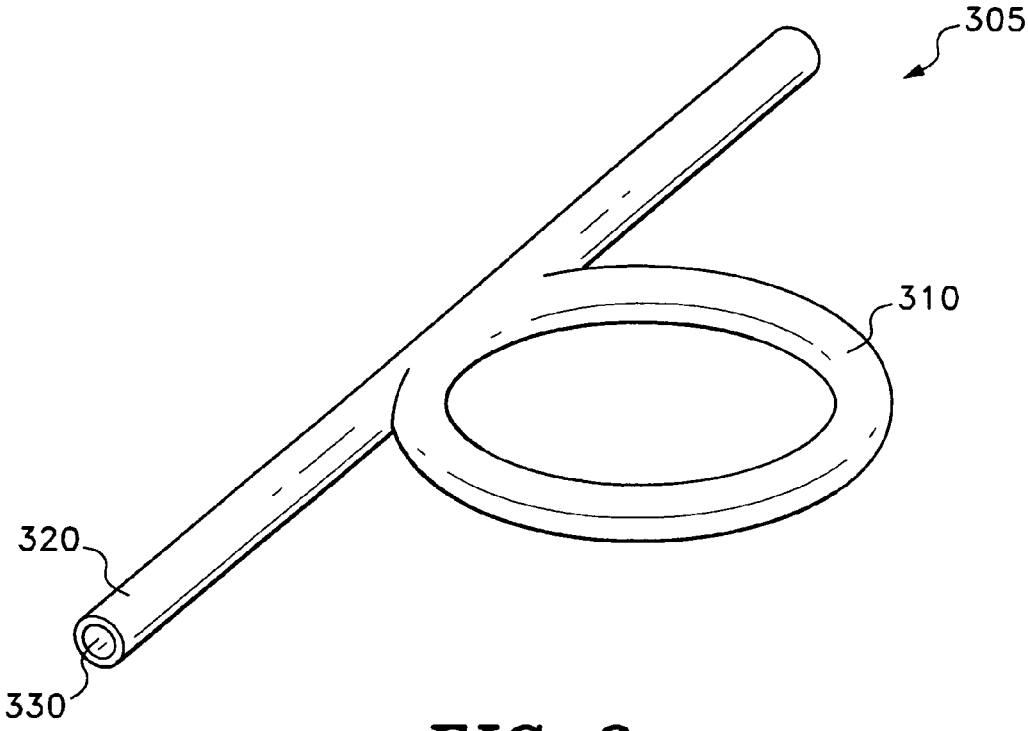
FIG. 3 is a perspective view of an adapter for attaching the T-post puller to a 3-point hitch tractor boom according to the present invention.

Referring to FIGS. 1-3, the present invention is a T-post puller 105 that has a hollow frame body 125, preferably rectangular, with a carrying handle 1200 and a frustopyramidal skirt 182 at the bottom of the frame 125. The frame 125 may by of unitary construction or it may be constructed of plates, such as side plate 40, rear plate 50, side plate 51, and front plate 120, which are welded or fastened together. Frame body 125 may be made from scrap metal, such as steel or aluminum. Attachment arms 110 and 200 form a yoke that extends from the top front corners of the frame 125 and may be welded to, fastened to, or unitarily fashioned from the same material as hollow frame 125.

Each attachment arm 200, 110 has a corresponding hole 60 and 111, respectively, defined therein for pivotally attaching the T-post puller 105 to a post hole digger boom 106 (the auger and driveline having been removed from the boom 106). As shown in FIG. 2A, attachment members 200 and 110 are upwardly sloped to provide a more stable attachment configuration to the lifting boom 106. Alternatively, as shown in FIG. 2B, an opposing pair of attachment arms 201 may be welded or otherwise attached to the frame 125 and upwardly sloped at the same angle from the horizontal as attachment arms 200 and 110 to form a second yoke. This allows the T-post puller 105 to be pivotally attached to the boom 106 with the rear plate 50 facing the tractor T.

Clevis pin 335 may be slid through attachment member pair 201 and retained by a hitch pin, cotter pin, or any other suitable retaining means inserted through the transverse bore at the end of the pin shaft. Similarly, clevis pin 335 may be slid through attachment arm 200 and attachment arm 110 and retained by a hitch pin, cotter pin, or other suitable retaining means. Attachment arms 110 and 200 are spaced apart so that the arms 110 and 200 fit closely on opposite sides of the transverse pin retainer cylinder at the end of boom 106.

As shown in FIG. 3, an adapter 305 is formed from an attachment ring 310 tangentially attached to the middle of a hollow, cylindrical rod 320, which defines a bore 330. Rod 320 is dimensioned to fit between the arms 110 and 200 forming the first yoke, or the arms 210 forming the second yoke, so that the adapter 305 can be secured to the T-post puller 105 by a clevis pin inserted through holes 60 and 111 and bore 330. The T-post puller 105 can then be attached to a conventional, general purpose three-point hitch boom on a tractor, or the boom or lifting mechanism of a backhoe, front end loader, or Bobcat, by using a chain, cable, or other the like wrapped through the ring 310. Alternatively, the T-post puller may be attached to an electric winch or hoist by a snap-hook, cable, or other connector attached to the ring 310.

The skirt 182 may be welded or fastened to the frame 125, or extruded, cast or forged in one piece with the frame 125. Preferably, the frame 125 is rectangular in cross section, so that the skirt 182 has the shape of a frustum of a rectangular pyramid. The skirt 182 is provided to aid in funneling or guiding the frame 125 over a T-post FP in preparation for lifting the T-post. The skirt 182 may be comprised of front plate 10, side plates 20 and 30, and rear plate 180, all welded or fastened together to form the skirt 182.

Components internal to the hollow frame 125 comprise a wedge or ratchet plate 70, a weight 90 attached to ratchet plate 70, and a ratchet plate axle 150 integral with and extending from ratchet plate 70. The ratchet plate 70 extends across the hollow interior the frame 125 and is pivotally mounted to the frame 125 by journaling the axle 150 through apertures 160 defined through the side plates 40 and 51.

A ratchet axle lever 130 is attached to an extension of the ratchet axle 150 on one side of the frame 125. The ratchet axle lever 130 is an elongated member having a notch or hole capable of supporting an end of tension spring 142. The opposite end of tension spring 142 is attached to spring anchor 140, as shown in FIG. 2A. Tension spring 142 biases ratchet plate 70 to pivot downward across the hollow opening defined by frame 125 so that when the frame 125 is placed over a T-post, the ratchet plate 70 slides over the studs projecting from the flat face of the post and becomes wedged under the next highest stud when the frame 125 is pulled upward by the boom 106. Wedge plate 70 may be wider than the width of hollow frame 125 so that wedge plate 70 only rotates through a quadrant less than 90° between horizontal and vertical. Weight 90 also bears on the top of wedge or ratchet plate 70, also biasing the ratchet plate 70 downward to retain the ratchet plate 70 wedged against the T-post if the spring 142 should become dislodged or fail. The T-post puller 105 is designed to operate with either spring 142 or weight 90 used independently, the combination being provided for ease in operation and to preclude the necessity for stopping pulling operations for repairs.

Lever 130 may have a hole 131, loop, notch, or other attachment point defined in its free end for attaching a nylon rope or cord 133 to the lever 130. The rope 133 extends to the driver's seat or cabin of the tractor T and provides a release mechanism for releasing a T-post from the puller 105 after the post has been pulled from the ground. The operator pulls on the rope 133, causing lever 130 to rotate, lifting wedge or ratchet plate 70 out from under the post stud and towards front plate 120, thereby permitting the T-post to fall out of the frame 125.

In use, the operator backs the tractor T up to the T-post FP and positions the T-post puller 105 above the post FP. The operator then lowers the boom 106, the skirt 182 helping to guide the frame 125 over the post FP. The boom 106 is lowered far enough to position the frame 125 at about the middle of the post 125, the yoke formed by arms 110 and 200 pivoting the frame 125 away from the end of the boom 106 so that the boom 106 does not drive the post FP farther into the ground. The boom 106 is raised, the ratchet plate 70 being wedged beneath the T-post studs in order to grip the post FP so that raising the boom 106 pulls the post from the ground. The operator can then pull rope 133, rotating lever 130 to drop the T-post FP to the ground. A skilled tractor operator can pull three to five posts per minute with the T-post puller 105 of the present invention.

It is to be understood that the present invention is not limited to the embodiments described above, but encompasses any and all embodiments within the scope of the following claims.

We claim:

1. A T-post puller, comprising:

a frame body having at least one sidewall defining an open top end, an open bottom end, and a hollow interior extending between the open top and bottom ends;

a pair of arms sloping outwardly from the top end of the frame body, the arms defining a first yoke adapted for pivotal attachment to an end of a tractor's post hole digging boom;

a wedge plate pivotally disposed in the hollow interior of the frame body, the wedge plate pivoting between a first position extending across the interior of the frame body and a second position adjacent the sidewall, the wedge plate being adapted for sliding over a flat plate of a T-post and wedging under a stud extending from the T-post when the frame body is lifted, said wedge plate having an axle integral therewith extending to opposing sides of said wedge plate, the axle being journalled through the at least one sidewall of said frame body, said wedge plate pivoting about the axle, said wedge plate further having a substantially planar contour;

means for biasing the wedge plate in the first position; and, means for remotely and selectively pivoting said wedge plate about said axle in order to selectively disengage the wedge plate from the T-post, said means for remotely and selectively pivoting said wedge plate being user-actuatable.

2. The T-post puller according to claim 1, wherein the frame body is substantially rectangular in cross section.

3. The T-post puller according to claim 1, wherein the frame body is of unitary construction.

4. The T-post puller according to claim 1, wherein each of the arms defining the first yoke has a bore defined therein adapted for facilitating pivotal attachment to the post hole digging boom.

5. The T-post puller according to claim 4, further comprising:

a clevis pin having a shaft slidably disposed through the bores defined in the pair of arms, the clevis pin including a shaft, a transverse bore being formed in said shaft; and a pin removably inserted through the transverse bore in the clevis pin for retaining the clevis pin in position across the pair of arms.

6. The T-post puller according to claim 1, wherein the pair of arms slope upward from the top end of the frame body.

7. The T-post puller according to claim 1, further comprising: a second pair of arms identical in configuration to the pair of arms, the second pair of arms being disposed outwardly from side of the frame body opposite the first yoke to define a second yoke adapted for pivotal attachment to the end of the tractor's post hole digging boom.

8. The T-post puller according to claim 1, further comprising an axle lever extending from said axle, said means for biasing said wedge plate in the first position comprising a spring extending between the axle lever and said frame body.

9. The T-post puller according to claim 8, wherein said means for remotely and selectively pivoting said wedge plate about said axle comprises a release cable attached to the axle lever for pivoting the wedge plate to the second position in order to release the T-post after pulling the T-post from the ground, said release cable having opposed first and second ends, the first end being attached to said axle lever, the second end being adapted for grasping by the user.

10. The T-post puller according to claim 1, wherein said means for biasing said wedge plate in the first position comprises a weight attached to said wedge plate.

11. The T-post puller according to claim 1, further comprising a frustopyramidal skirt extending from the open bottom end of said frame body for guiding said frame body over a T-post, said frustopyramidal skirt having an open lower end adapted for receiving the T-post.

12. The T-post puller according to claim 1, wherein each of the arms defining the first yoke has a bore defined therein, the T-post puller further comprising an adapter having a hollow, cylindrical rod and a ring tangentially attached to the hollow rod, the rod having opposing ends mountable in the bores defined in the first yoke, the rod being adapted for being secured to the first yoke by a clevis pin, the ring being adapted for releasable attachment to a 3-pont tractor boom.

13. A T-post puller, comprising:

a frame body having a front wall, a rear wall, and a pair of opposing sidewalls joining the front wall and the rear wall to define an elongated rectangular body defining an open top end, an open bottom end, and a hollow interior extending between the open top and bottom ends;

a frustopyramidal skirt extending from the open bottom end of the frame body for guiding the frame body over a T-post, said frustopyramidal skirt having an open lower end adapted for receiving the T-post;

means for attaching the frame body to a power lifting machine;

a wedge plate pivotally disposed in the hollow interior of the frame body, the wedge plate pivoting between a first position extending across the interior of the frame body and a second position adjacent one of the sidewalls, the wedge plate being adapted for sliding over a flat plate of the T-post and wedging under a stud extending from the T-post when the frame body is lifted, said wedge plate having an axle integral therewith extending to opposing sides of said wedge plate, the axle being journalled through the pair of opposing sidewalls of said frame body, said wedge plate pivoting about the axle, said wedge plate further having a substantially planar contour;

means for biasing the wedge plate in the first position; and, means for remotely and selectively pivoting said wedge plate about said axle in order to selectively disengage the wedge plate from the T-post, said means for remotely and selectively pivoting said wedge plate about said axle including a release cable, mounted at a first end thereof to said wedge plate, and having a second end adapted to be selectively held and engaged by the user.

14. A T-post puller, comprising:

a frame body having at least one sidewall defining an open top end, an open bottom end, and a hollow interior extending between the open top and bottom ends;

means for attaching the frame body to a power lifting machine;

a wedge plate having an axle extending from opposing ends thereof, the axle being journalled into the at least one sidewall of the frame body in order to be pivotally disposed in the hollow interior of the frame body, the wedge plate pivoting between a first position extending across the interior of the frame body and a second position adjacent the sidewall, the wedge plate being adapted for sliding over a flat plate of a T-post and wedging under a stud extending from the T-post when the frame body is lifted, said wedge plate having a substantially planar contour;

means for biasing the wedge plate in the first position;

a lever attached to the wedge plate axle, the lever having a free end; and a release cable attached to the free end of the lever for pivoting the wedge plate to the second position in order to release the T-post after pulling the T-post from the ground.

* * * * *